US009632464B2

(12) United States Patent
Shiki et al.

(10) Patent No.: US 9,632,464 B2
(45) Date of Patent: Apr. 25, 2017

(54) IMAGE FORMING APPARATUS

(71) Applicant: Konica Minolta, Inc., Tokyo (JP)

(72) Inventors: Takanobu Shiki, Sagamihara (JP); Tadayuki Ueda, Kokubunji (JP); Eiji Nishikawa, Tama (JP); Yukinobu Iguchi, Hamamatsu (JP); Satoshi Miyajima, Hino (JP); Yohei Yamada, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/135,027

(22) Filed: Apr. 21, 2016

(65) Prior Publication Data

US 2016/0327889 A1 Nov. 10, 2016

(30) Foreign Application Priority Data

May 8, 2015 (JP) ..... 2015-095872

(51) Int. Cl.
*G03G 15/20* (2006.01)

(52) U.S. Cl.
CPC ..... *G03G 15/2039* (2013.01); *G03G 15/205* (2013.01)

(58) Field of Classification Search
CPC ..... G03G 15/2078; G03G 15/2067
See application file for complete search history.

(56) References Cited

U.S. PATENT DOCUMENTS 5,682,577 A * 10/1997 Kiyoi ..... G03G 15/2039 219/494
2009/0297199 A1 12/2009 Yamashina et al.
2012/0230717 A1* 9/2012 Suzuki ..... G03G 15/2039 399/68
2012/0230744 A1* 9/2012 Maruyama ..... G03G 15/2039 399/335

FOREIGN PATENT DOCUMENTS

JP 2010015130 A 1/2010

* cited by examiner

*Primary Examiner* — Clayton E Laballe
*Assistant Examiner* — Victor Verbitsky
(74) *Attorney, Agent, or Firm* — Lucas & Mercanti, LLP

(57) ABSTRACT

In an image forming apparatus according to the present invention, when an image forming operation is started from a standby state, electric power is supplied to a heater by switching to a first fixing control to turn on and off the heater to heat a heating roller with a fixed duty ratio based on the detected temperature of the heating roller, and thereafter, when detecting a state that the falling detected temperature reaches a lower limit value at which the detected temperature turns to rising, electric power is supplied to the heater by switching to a second fixing control which changes a duty ratio in accordance with a temperature difference between the detected temperature and a target control temperature.

9 Claims, 11 Drawing Sheets

COMPARATIVE EXAMPLE

SWITCHING TO SECOND FIXING CONTROL IS TOO LATE

EXAMPLE

SWITCHING TO SECOND FIXING CONTROL AT THE TIMING OF DETECTING LOWER LIMIT VALUE

FIG.14

| | | ARRAIVAL TIME(tx) | | |
|---|---|---|---|---|
| | | LESS THAN 3 SECONDS | 3 SECONDS OR MORE AND LESS THAN 5 SECONDS | 5 SECONDS AND MORE |
| TEMPERATURE DIFFERENCE (T1-T2) | LOWER THAN 5℃ | 3 | 4 | 6 |
| | 5℃ OR HIGHER AND LOWER THAN 10℃ | 4 | 5 | 8 |
| | 10℃ OR HIGHER | 6 | 8 | 10 |

FIG.15

| IN-MACHINE TEMPERATURE | P CONSTANT |
|---|---|
| 50℃ OR HIGHER | 3 |
| 30℃ OR HIGHER AND LOWER THAN 50℃ | 5 |
| LOWER THAN 30℃ | 10 |

FIG.16

| SHEET CONVEYING SPEED | P CONSTANT |
|---|---|
| LOW SPEED | 3 |
| ORDINARY SPEED | 5 |
| HIGH SPEED | 10 |

IMAGE FORMING APPARATUS

CROSS-REFERENCE TO RELATED APPLICATION

This application is based on Japanese Patent Application No. 2015-095872 filed on May 8, 2015, the contents of which are incorporated herein by reference.

BACKGROUND

1. Technical Field

The present invention relates to an image forming apparatus.

2. Description of Related Arts

In an image forming apparatus according to an electrophotographic system, in order to fix a toner image formed on a sheet, a fixing apparatus is used. The fixing apparatus is constituted by a heating roller and a pressing roller which comes in pressure contact with the heating roller, and the fixing apparatus conveys a sheet (i.e. a paper sheet) to a fixing nip portion formed between both the rollers, and performs heating and pressing treatment, thereby fixing a toner image onto the sheet.

Generally, the temperature control of the fixing apparatus controls electric power supply to a heater to heat the heating roller such that the detected temperature of a temperature sensor to detect the surface temperature of the heating roller becomes a predetermined target control temperature. As a temperature control method during printing, an ON/OFF control or a PID control (Proportional-Integral-Derivative Control) is used. When the detected temperature is lower than the target control temperature, the ON/OFF control supplies a fixed electric power to the heater. In the ON/OFF control, temperature ripples occur with a phenomena in which overshoot and undershoot occur alternately. That is, after the surface temperature of the heating roller has been heated to the target control temperature, overshoot occurs with a phenomena that the temperature continues to rise more excessively. Thereafter, at the time of returning the rising temperature to the target control temperature, next, undershoot occurs with a phenomena reverse to the phenomena of the overshoot. A PID control controls electric power supply by switching it in multi-stages in accordance with a temperature difference between a detected temperature and a target control temperature or a change of a detected temperature. In the case where printing is started and fixing is started successively for a plurality of sheets, alternatively, in the case where the pressing roller is not heated sufficiently up to its inside at the time of starting printing and an amount of heat of the hating roller shifts to the pressing roller, since heat supply by a heater runs short, the temperature of the heating roller falls at the initial stage. As compared with the ON/OFF control, in the PID control, there is a problem that such a temperature fall at the initial stage at the time of starting printing becomes large.

Patent Literature 1 (Japanese unexamined Patent Publication No. 2010-15130) discloses an image forming apparatus. In the image forming apparatus, when a returning operation is performed to raise the temperature of a heating roller from a standby state of being heated at a standstill to a temperature capable of passing a sheet, electric power is supplied by an ON/OFF control during a predetermined time period from the time when the heating roller has started rotating. Successively, after the predetermined time period has elapsed, the returning operation is switched to a heating operation by a PID control.

In the technique disclosed by Patent Literature 1, the control is switched from an ON/OFF control to a PID control in accordance with the elapsed time from the rotation start of the heating roller. Accordingly, in the case where switching timing is too late, a problem arises in that undershoot becomes larger at the initial stage. On the other hand, in the case where switching timing is too early, another problem arises in that overshoot becomes larger.

The present invention has been achieved in view of the above-mentioned circumstances, and an object of the present invention is to provide an image forming apparatus which enables the temperature of a fixing member to converge to a target control temperature early at the time of starting an image forming operation and can minimize undershoot, overshoot, and temperature ripples.

SUMMARY

To achieve at least the above mentioned object, an image forming apparatus reflecting one aspect of the present invention comprises:

a sheet feeding tray which stores sheets;

a sheet conveying unit which conveys a sheet stored in the sheet feeding tray;

an image forming unit which forms a toner image on the sheet conveyed by the sheet conveying unit;

a fixing member which heats and fixes the toner image formed by the image forming unit onto the sheet;

a temperature sensor which detects the temperature of the fixing member;

a heater which heats the fixing member;

an electric power supplying unit which switches ON and OFF of the heater in accordance with a duty ratio which represents a ratio of an ON period to supply electric power to the heater within a predetermined cycle; and a controller which determines the duty ratio based on the detected temperature of the temperature sensor and controls the electric power supplying unit based on the determined duty ratio so as to supply electric power to the heater;

wherein the controller can control the electric power supplying unit by a first fixing control which turns on the heater with a fixed duty ratio when the detected temperature is equal to or lower than a target control temperature and turns off the heater when the detected temperature is higher than the target control temperature and by a second fixing control which changes the duty ratio in accordance with a temperature difference between the detected temperature and the target control temperature, and wherein when an image forming operation is started from a standby state in which the fixing member is subjected to temperature control such that the detected temperature becomes a predetermined control temperature, the controller supplies electric power to the heater by the first fixing control, thereafter, when detecting a state that the falling detected temperature reaches a lower limit value at which the detected temperature turns to rising, the controller switches to the second fixing control and supplies electric power to the heater by the second fixing control.

BRIEF DESCRIPTION OF THE DRAWINGS

FIG. 14 is an example of a table to determine a control parameter in accordance with the kind of a sheet.

FIG. 15 is an example of a table to determine a control parameter in accordance with the detected temperature of an in-machine temperature sensor 129 in a modified embodiment.

FIG. 16 is an example of a table to determine a control parameter in accordance with a sheet conveying speed in a modified embodiment.

DETAILED DESCRIPTION

Figure 1:
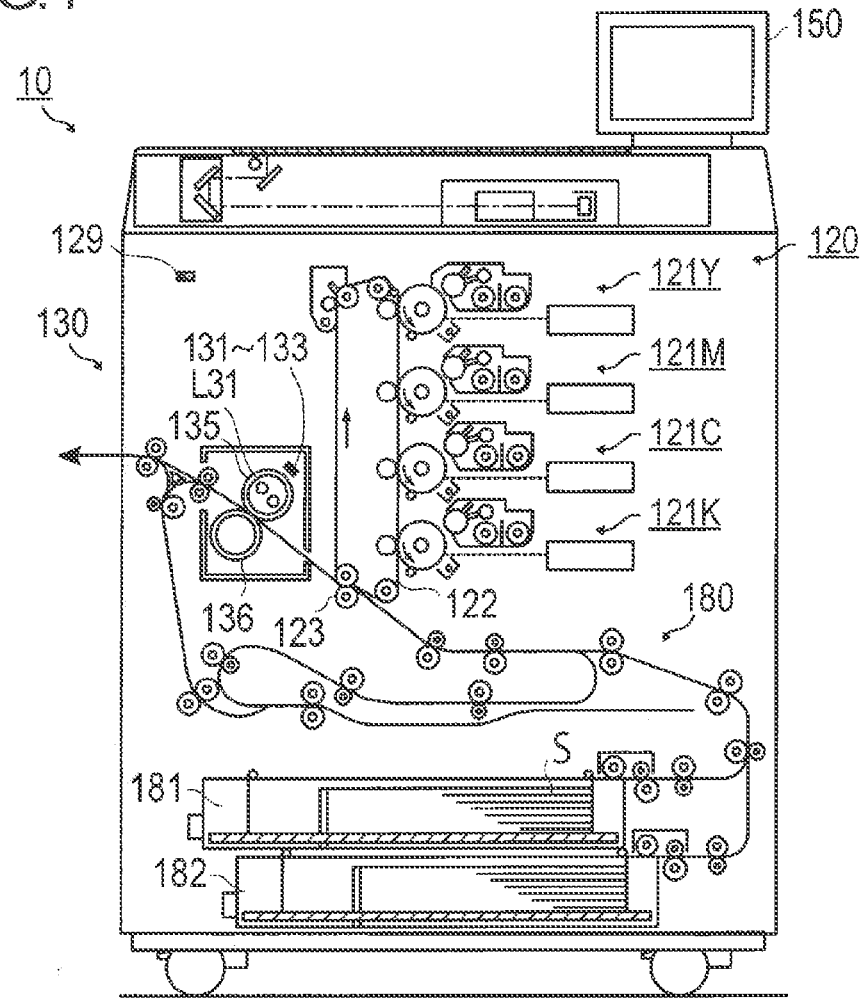
FIG. 1 is a drawing showing an outline constitution of an image forming apparatus 10 according to an embodiment.

Hereinafter, an embodiment of the present invention will be described with reference to the attached drawings. In the description of the drawings, the same element is provided with the same reference symbol, and overlapping description is omitted. The dimension ratios in the drawings are exaggerated on account of description. Accordingly, the dimension ratios may be different form the respective actual dimension ratios.

Figure 2:
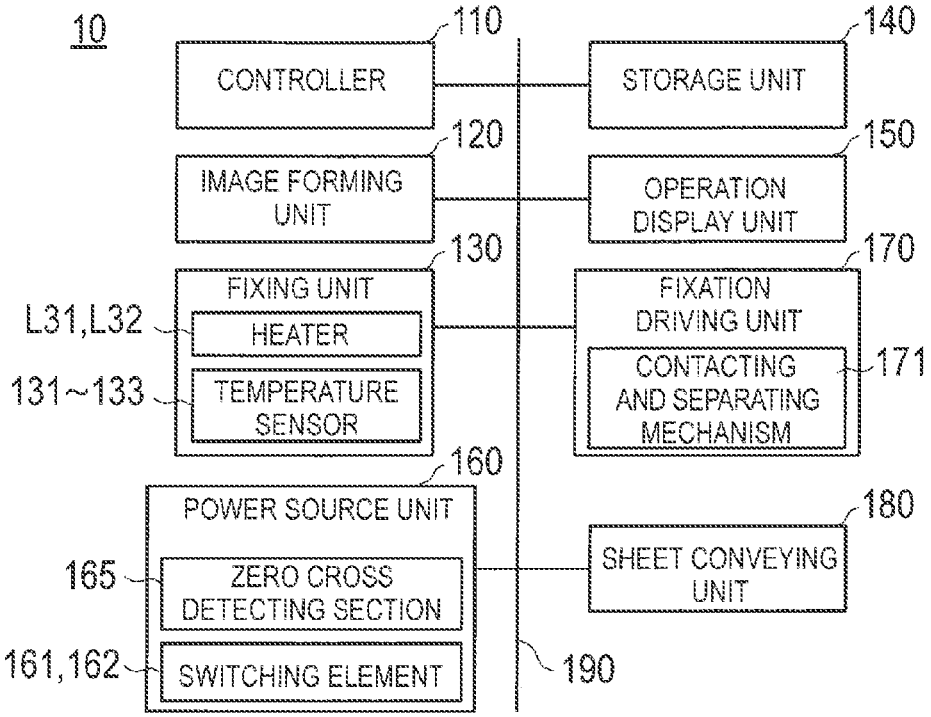
FIG. 2 is a block diagram showing a hardware constitution of the image forming apparatus 10.
Figure 3:
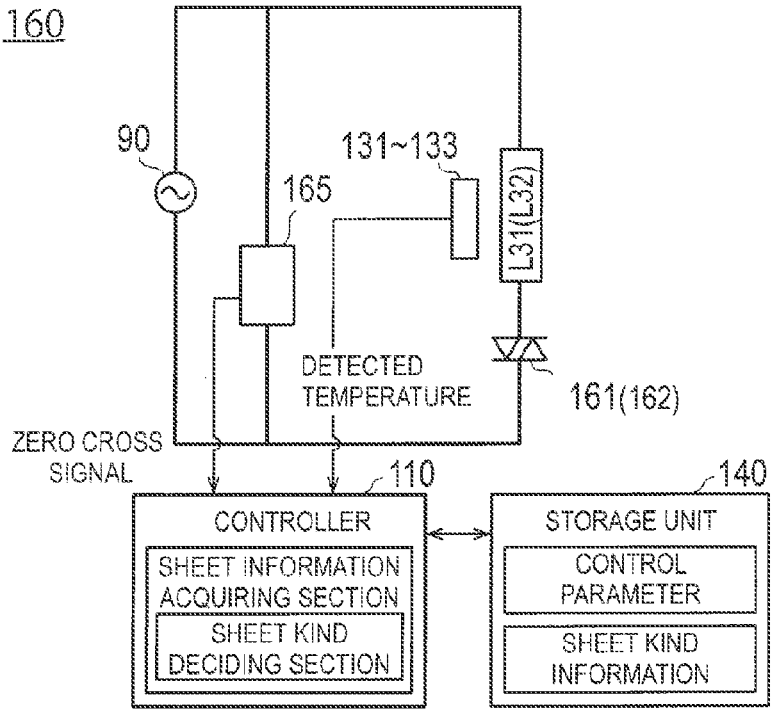
FIG. 3 is a schematic diagram mainly showing a constitution of a power source unit 160.

FIG. 1 is a drawing showing an outline constitution of an image forming apparatus 10 according to an embodiment. FIG. 2 is a block diagram showing a hardware constitution of the image forming apparatus 10. FIG. 3 is a schematic diagram mainly showing a constitution of a power source unit 160.

As shown in FIG. 1 and FIG. 2, the image forming apparatus 10 includes a controller 110, an image forming unit 120, a fixing unit 130, a storage unit 140, an operation display unit 150, the power source unit 160, a fixation driving unit 170, a sheet conveying unit 180, and signal lines 190 which connects among these units.

The controller 110 includes a CPU, a RAM, and a ROM, reads out various programs stored in the ROM and the storage unit 140 appropriately, develops the programs onto the RAM, and controls the CPU to execute the programs, thereby realizing various functions. One example of the functions to be realized includes a sheet information acquiring section as shown in FIG. 3. The sheet information acquiring section includes a sheet kind deciding section. The contents of the sheet kind deciding section will be described later (with reference to FIG. 13).

The image forming unit 120 includes development units 121Y to 121K corresponding to color toners of Y, M, C, and K respectively. Different color toner images are formed separately by the respective development units 121Y to 121K through electrification, image exposure and development processes, superimposed on each other sequentially on an intermediate transfer belt 122, and transferred onto a sheet (paper sheet) S with a secondary transfer roller 123. An in-machine temperature sensor 129 is a temperature sensor to measure a temperature in the main body of the image forming apparatus 10 and detects an atmospheric temperature in the vicinity of the fixing unit 130.

The fixing unit 130 including a heating roller 135 and a pressing roller 136 acting as a fixing member, performs pressing and heating treatment for a sheet S conveyed into a fixing nip portion formed between both the rollers 135 and 136, and melts and fixes a toner image on the sheet S onto its surface.

FIG. 4 is an illustration showing the fixing unit 130. As shown in FIG. 4, the heating roller 135 includes, in the order from the inner side, a core metal 135*a* composed of a metal cylinder, an elastic layer 135*b* which is formed on the core metal 135*a* and composed of raw materials, such as a silicone rubber and a foamed silicone rubber, and a releasing layer 135*c* such as a fluororesin. On the inside of the core metal 135*a*, a plurality of halogen lamp heaters L31 and L32 are disposed. The heating roller 135 disposed in the direction orthogonal to the conveyance direction of a sheet S has a length, in a rotation axis direction (hereafter, merely referred to as "width direction"), which is long enough to be able to fix a sheet S with a maximum sheet width capable of being conveyed. The plurality of heaters L31 and L32 may be constituted by heaters with respective different heat distributions (light distribution characteristics) corresponding to multi-stepped different sheet widths capable of being conveyed in the apparatus. For example, the heater L31 may be a central type heater with a calorific value distribution in which the calorific value of the central portion is larger than that of each of the end portions, and the heater L32 may be an end type heater with a calorific value distribution in which the calorific value of each of the end portions is larger than that of the central portion. The number of heaters is not limited to two heaters, may be a single heater, and may be three or more heaters.

The pressing roller 136 includes, in the order from the inner side, a core metal 136*a* composed of a metal cylinder, an elastic layer 136*b* which is formed on the core metal 136*a* and composed of raw materials, such as a silicone rubber and a foamed silicone rubber, and a releasing layer 136*c* such as a fluororesin. The outside diameter and axial direction length of the pressing roller 136 are almost equivalent to those of the heating roller 135. On the inside of the core metal 136*a* of the pressing roller 136, also, a heater may be disposed.

Each of temperature sensors 131 to 133 detects the temperature of the surface of the heating roller 135. The temperature sensors 131 to 133 are arranged at respective different positions in the width direction, such as the central portion, the back side, and the front side, so as to measure the temperature distribution in the width direction of the heating roller 135. As each of the temperature sensors 131 to 133, for example, a thermistor arranged in a non-contact state for the heating roller 135 is used.

The storage unit 140 is an auxiliary storage device constituted by a semiconductor memory, such as HDD and SSD. The storage unit 140 stores multiple kinds of control parameters or a control table to calculate a duty ratio from the respective detected temperatures of the temperature sensors 131 to 133.

The operation display unit 150 includes, for example, an LCD (liquid crystal display) and a touch sensor disposed so as to be superimposed on the display surface of the LCD. The operation display unit 150 displays an operation screen and receives various operations by a user. The user can set the sheet kind information of a sheet stored in each of sheet feeding trays 181 and 182 via the operation display unit 150. Example of the sheet kind information include the brand of a sheet, the kind of a sheet (the weight of a sheet), and the type of a sheet (a coated sheet, a regular sheet, etc.). The set sheet kind information is correlated with the sheet feed trays 181 and 182, and stored in the storage unit 140.

The power source unit 160 functions as an electric power supplying unit, and includes a plurality of switching elements 161 and 162 and a zero cross detecting section 165. As shown in FIG. 3, the power source unit 160 is connected to a commercial alternating current power source 90 with a voltage of 100 V and a frequency of 50/60 Hz, and supplies electric power to each constitution of the heaters L31 and L32 and the image forming apparatus 10. The zero cross detecting section 165 outputs a zero cross signal at a timing when the voltage output of the commercial alternating current power source 90 crosses a voltage level of 0 V. As show in FIG. 3 with an omitting manner, each of the heaters L31 and L32 is connected in parallel with the alternating current power source 90, and switching elements 161 and 162 are disposed on the respective electric power lines corresponding to the heaters L31 and L32, respectively.

The controller 110 controls the power source unit 160, and performs duty control. The duty control makes a prescribed period of an integral multiple of a half wave of the commercial alternating current power source 90 as a control cycle by using the zero cross signals, and supplies electric power in multi-stages to the heaters L31 and L32. For example, fifteen half wavelengths is made as the control cycle. In a commercial power source with a frequency of 50 Hz, the control cycle of fifteen half wavelengths is equivalent to 300 msec. The controller 110 controls the switching element 161 (162) in synchronization with the zero cross signals so as to perform an ON/OFF control in units of a half wave for the heater L31 (L32). Among fifteen half waves within the control cycle, for example, in the case where the heater L31 is turned ON during a period of a single half wave, a duty ratio becomes 6.7%, and in the case where the heater L31 is turned ON during a period of fifteen half waves (whole period), a duty ratio becomes 100%. The storage unit 140 stores an arrangement pattern which shows a combination of ON and OFF periods which indicates how to select (ON) which half wave period among fifteen half waves.

The fixation driving unit 170 includes a driving motor, and, with this, drives the heating roller 135 or both the heating roller 135 and the pressing roller 136 so as to rotate. The fixation driving unit 170 further includes a contacting and separating mechanism 171 constituted by a cam mechanism and a driving source.

Figure 4A:
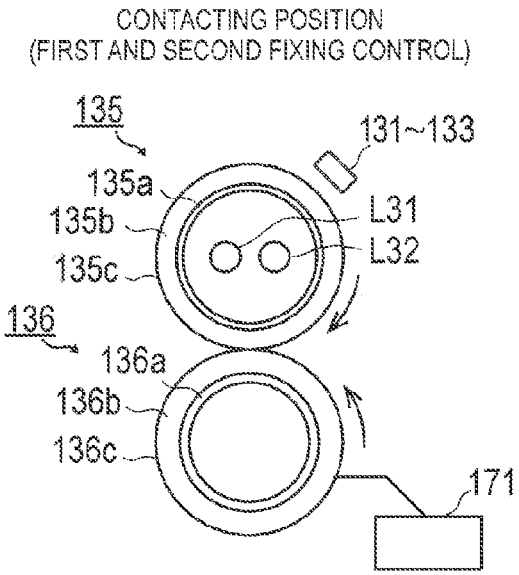
FIG. 4A is an illustration showing a state of a fixing unit 130 at a contacting position.
Figure 4B:
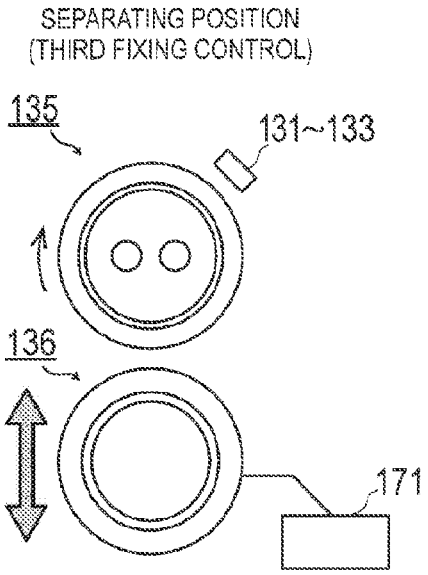
FIG. 4B is an illustration showing a state of the fixing unit 130 at a separating position.

As shown in FIGS. 4A and 4B, the pressing roller 136 is moved upward and downward in the arrowed directions along a straight line connecting the respective center points of the heating roller 135 and the pressing roller 136 by the contacting and separating mechanism 171. At a "contacting position" shown in FIG. 4A, the pressing roller 136 is energized toward the heating roller 135 with a predetermined pressure, and a fixing nip portion is formed between both the rollers. A pressure and heat fixing treatment is performed for a sheet S which is passing through the fixing nip portion. At a "separating position" shown in FIG. 4B, the pressing roller 136 is displaced below. At the separating position, the pressing roller 136 and the heating roller 135 are brought in non-contact with each other. A "standby state" is set at the separating position. In the standby state, the pressing roller 136 is standing still. However, the heating roller 135 is rotating at a rotation speed lower than an ordinary rotation speed (at the time of image formation).

The sheet conveying unit 180 includes a plurality of sheet feeding trays 181 and 182 and a plurality of paired conveying rollers driven with a conveyance motor (not shown). A number of sheets S is stored inside each of the sheet feed trays 181 and 182. The stored sheets S are fed one by one to a conveyance passage on the downstream side. The conveying speed of a sheet S by the sheet conveying unit 180 and the conveying speed of a sheet S at the fixing nip position by the fixation driving unit 170 can be changed into multi-stages. For example, the conveying speed is changed to a "high speed" higher than an ordinary speed and to a "low speed" lower than the ordinary speed by the setting of fixing gloss intensity. At the high speed, the conveying speed is increased by 20% than the ordinary speed, and at the low speed, the conveying speed is decreased by 20% than the ordinary speed. The setting of gloss intensity can be selected by a user via the operation display unit 150.

(Fixing Temperature Control According to a First Embodiment)

Figure 5:
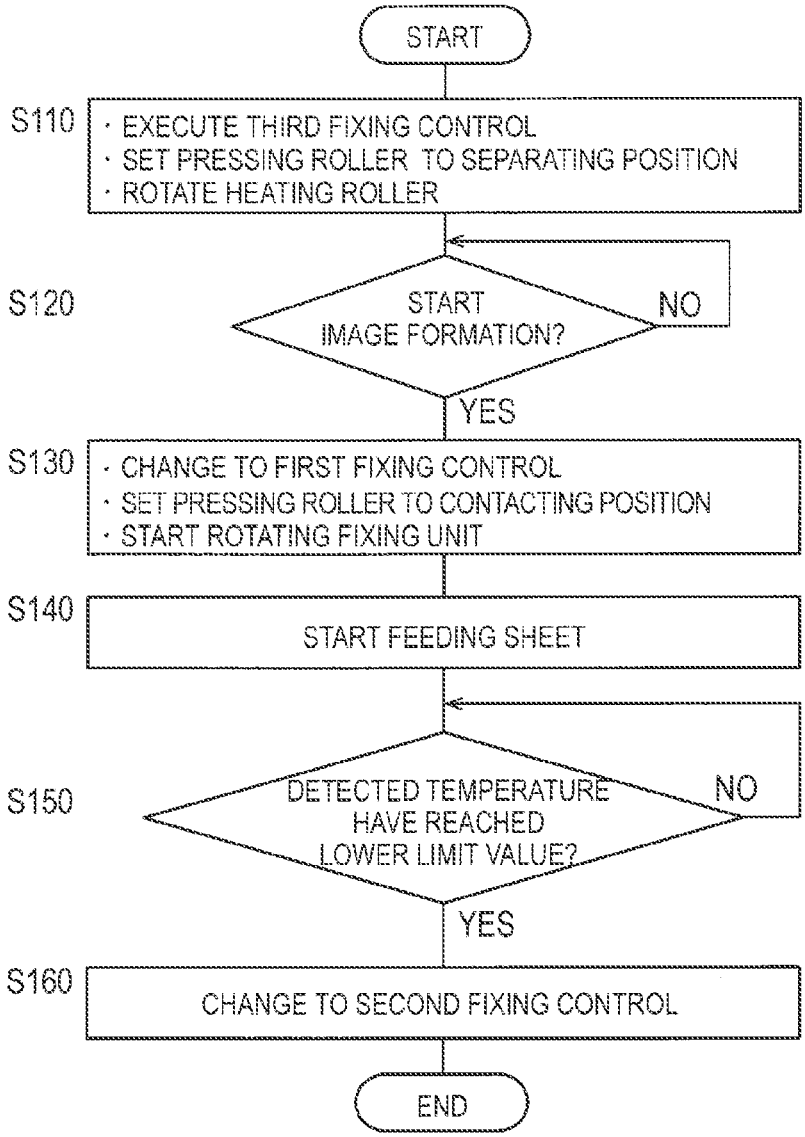
FIG. 5 is a flowchart showing a fixing temperature control according to a first embodiment.
Figure 6:
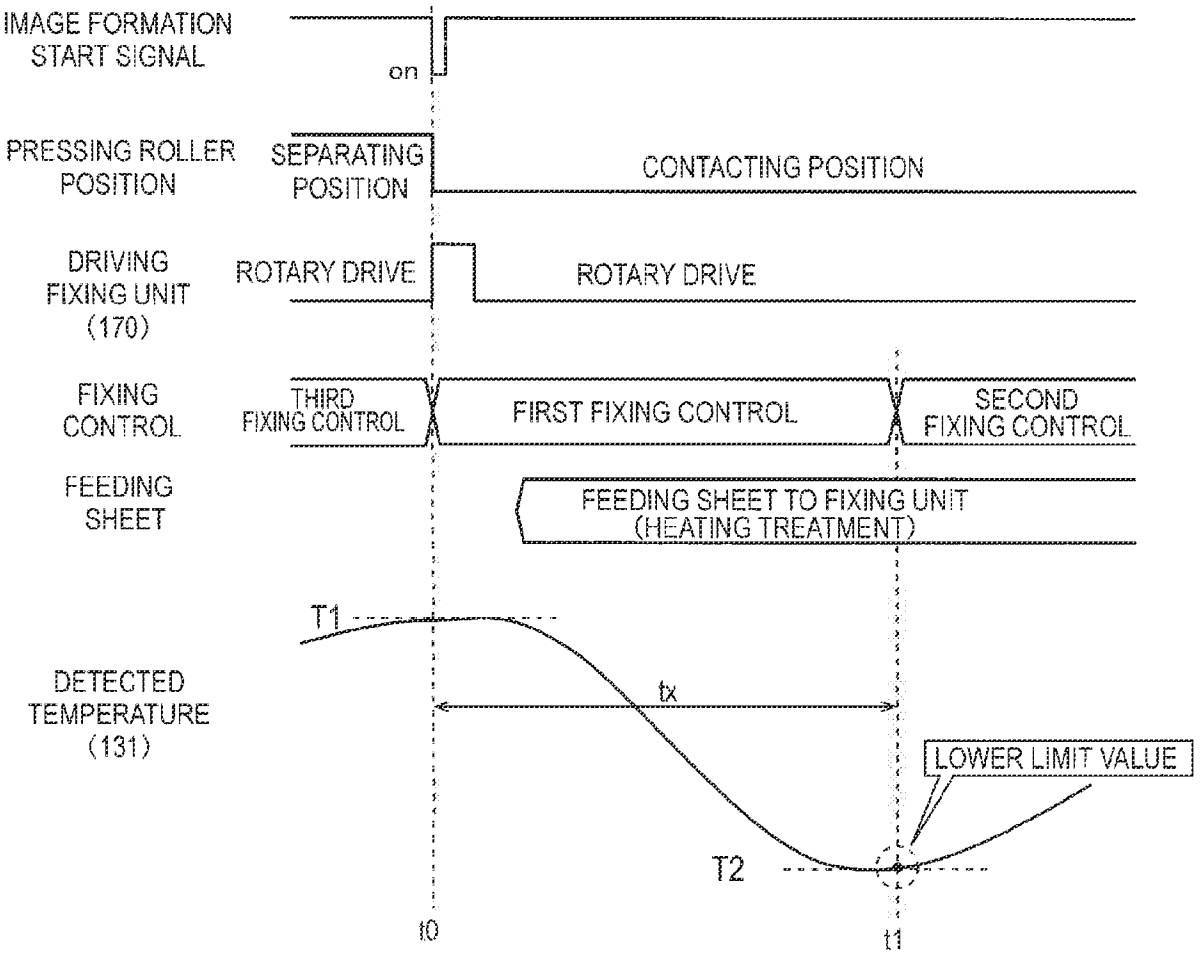
FIG. 6 is a diagram showing a timing chart of each signal and the temperature transition of a heating roller 135.

Next, with reference to FIG. 5 and FIG. 6, the fixing temperature control according to the first embodiment is described. FIG. 5 is a flowchart showing the fixing temperature control executed by the controller 110 according to the first embodiment, and FIG. 6 is a diagram showing a timing chart of each signal and the temperature transition of the heating roller 135.

Herein, first to third fixing controls controlled by the controller 110 are described. In the "first fixing control", in the case where the respective detected temperatures of the temperature sensors 131 to 133 are equal to or lower than a target control temperature (Tv1), the heaters L31 and L32 are turned ON with a fixed duty ratio, and in the case where the respective detected temperatures are higher than the target control temperature (Tv1), the heaters L31 and L32 are turned OFF. For example, in the case where the detected temperature of the temperature sensor 131 to detect the surface temperature of the heating roller 135 at the center in the width direction is equal to or lower than the target control temperature (Tv1: for example, 180° C.), the heaters L31 and L32 are turned ON with a duty ratio of 100%. In the "second fixing control", a duty ratio (0 to 100%) is changed in accordance with a difference temperature between a detected temperature and the target control temperature (Tv1). As a control method, a proportional control which increases or decreases the duty ratio in proportion to the difference temperature, a PI control which combines a proportional control and an integral control, or a PID control which combines a proportional control, an integral control, and a derivative control can be applied. In the "third fixing control" which is a heater temperature control at the time of standby, a duty ratio (0 to 100%) is changed in accordance with a difference temperature between a prescribed control temperature (Tv2) and a detected temperature at the time of control with the control temperature (Tv2) which is lower than or equal to the target control temperature (Tv1) in the first and second fixing controls. Hereinafter, in order to make description easy, it is premised that the heaters L31 and L32 are controlled with the same duty ratio, and the description about the individual control of each of the heaters L31 and L32 is omitted. Actually, in the case of applying the heaters L31 and L32 with the respective different heat distributions, it is necessary to determine the respective duty ratios of the heaters L31 and L32 in consideration of a combination (a temperature distribution in the width direction) of the respective detected temperatures of the temperature sensors 131 to 133.

At Step S110 in FIG. 5, the fixing unit 130 is in a standby state. In FIG. 6, Step S110 corresponds to a period before the time t0. At this time, electric power is supplied to the heater L31 or the heater L32 by the third fixing control, and the temperature of the heating roller 135 is maintained at the control temperature (Tv2). The position of the pressing roller 136 is set to the separating position shown in FIG. 4B with the contacting and separating mechanism 171. In this standby state, only the heating roller 135 is driven to rotate by the fixation driving unit 170. Since the heating roller 135 is driven to rotate even in the standby state, the temperature distribution in the circumferential direction of the heating roller 135 can be maintained at a uniform state. That is, at a time point when an image forming operation is started, the temperature distribution of the circumferential direction of the heating roller 135 is uniform.

At the following Step S120, when an image formation start instruction is input by operation of a copy button (not shown) by a user (S120: YES), the controller 110 changes the fixing control from the third fixing control to the first fixing control at Step S130. Further, the controller 110 moves the pressing roller 136 to the contacting position (FIG. 4A), and after the moving, again, the controller 110 drives the heating roller 135 and the pressing roller 136 to rotate. The decision of YES at Step S120 corresponds to the time t0 in FIG. 6. The image forming operation is started at the time to, and, during the subsequent period, the image forming operation becomes an executing state.

After the time t0, electric power is supplied to the heaters L31 and L32 with a fixed duty ratio (for example, 100% for both the heaters) by the first fixing control. Thereafter, the image forming unit 120 forms a toner image on the surface of a sheet S which is fed one by one successively from the sheet feeding tray 181 at Step S140. These sheets are successively conveyed to the fixing nip portion of the fixing unit 130, and subjected to the heat fixing treatment.

Due to the heat fixing treatment for the sheet S and the drive start of the fixing unit 130, the temperature of the heating roller 135 falls. The reason why the temperature falls due to the drive start is as follows. At a time point of the time t0 immediately after the standby state has been cancelled, the inner temperature of the pressing roller 136 is lower than the temperature of the heating roller 135. Therefore, due to the rotation start of the fixing unit 130, a quantity of heat shifts from the heating roller 135 to the pressing roller 136, which makes the temperature of the heating roller 135 fall. In the case where a heater is disposed also inside the pressing roller 136 and the temperature of the pressing roller 136 is also maintained at a prescribed temperature in the standby state, the temperature fall of the heating roller 135 in association with this drive start is almost eliminated. In this case, a temperature fall is caused only by shifting of a quantity of heat from the heating roller 135 to a sheet S in association with the heat fixing treatment applied to the sheet S.

At Step S150, the controller 110 decides whether the detected temperature has reached a lower limit value. The controller 110 reads the detected temperature of the temperature sensor 131 with a prescribed cycle (for example, every 600 milliseconds). At Step S150, for example, in the case where the currently-detected temperature is equal to or higher than the most recently-detected temperature, alternatively, in the case where the read-in detected temperatures have been constant at multiple consecutive times or have increased, it can be decided that the detected temperatures have reached a lower limit value at which the detected temperature turns to rising for the first time after the standby state has been cancelled and the image forming operation has been started.

In the case where it has been decided that the detected temperature has reached the lower limit value (S150: YES), hereafter, the electric power is supplied to the heaters L31 and L32 by switching the fixing control from the first fixing control to the second fixing control, and then, the fixing control ends (S160 to End).

Effect

Hereinafter, with reference to FIG. 7 to FIG. 12, the effect of the present embodiment is described. Each of FIG. 7 to FIG. 11 is a diagram showing the temperature transition of the heating roller 135 in a comparative example, and FIG. 12 is a diagram showing the temperature transition of the heating roller 135 in an example. FIG. 12 corresponds to the embodiment explained with reference to FIG. 1 to FIG. 6. In each diagram of FIG. 7 to FIG. 12, the time t0 shows a timing at which an image formation start signal is input. The times after the time t0 show the transition of the detected temperatures of the heating roller 135 in the case where the position of the pressing roller 136 is changed from the separating position to the contacting position similarly to FIG. 6, then, rotation driving is started, and, thereafter, electric power is supplied to the heaters L31 and L32 by performing the fixing control shown in the respective diagrams such that the detected temperature becomes the target control temperature (Tv1). These diagrams are similar to that in FIG. 6. A lower limit temperature is a temperature at the lower limit with which toner can be fixed onto the surface of a sheet to such an extent that there is no problem in quality. In each diagram in FIG. 7 to FIG. 11, firstly, the fixing unit 130 in a room temperature state is warmed up to raise the temperature up to the predetermined control temperature (Tv2), then, the fixing unit 130 is maintained at a standby state (refer to FIG. 6) for a predetermined time period, and thereafter, sheets S are conveyed one by one successively to the fixing unit 130, and fixed similarly to FIG. 6.

Figure 7:
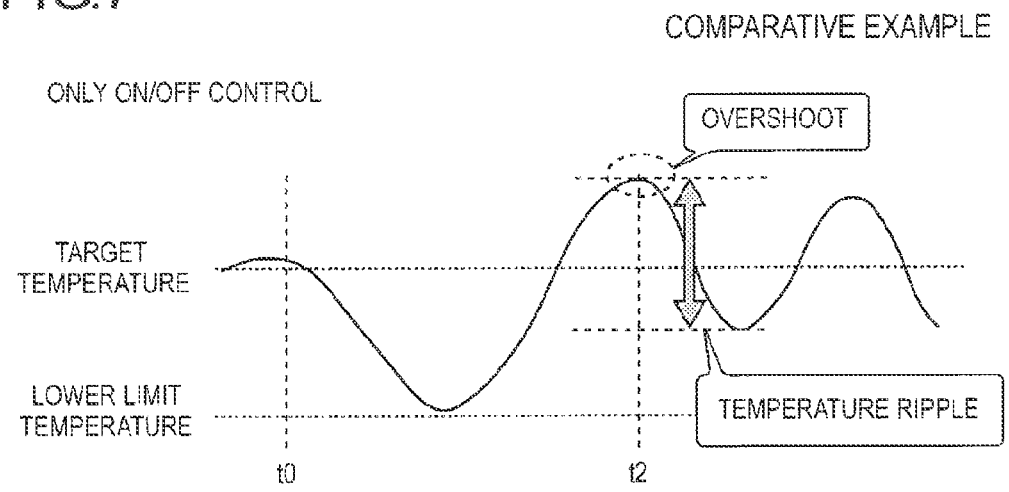
FIG. 7 is a diagram showing temperature transition in the case of using only an ON/OFF control as a fixing control of a comparative example.

FIG. 7 is a diagram showing temperature transition in the case of using only an ON/OFF control as the fixing control in a comparative example. When the detected temperature is equal to or less than the target temperature, the heaters L31 and L32 are turned ON with a duty ratio of 100%. Immediately after the time t0, heat accumulation in each portion of the fixing unit 130 such as the pressing roller 136 is not enough, and the inside of the pressing roller 136 is in a lower temperature state than the heating roller 135. Accordingly, when the fixing unit 130 starts rotating, a quantity of heat shifts from the heating roller 135 to the pressing roller 136. Thereby, the temperature of the heating roller 135 falls for a given period. In the ON/OFF control, the temperature does not become lower than the lower limit temperature. However, there is a problem that temperature ripples occur with a phenomena in which overshoot and undershoot occur alternately. That is, after the heating roller 135 has been heated to the target control temperature, overshoot (before and after the time t2) occurs with a phenomena that the temperature continues to rise more excessively. Thereafter, at the time of returning the rising temperature to the target control temperature, next, undershoot occurs with a phenomena reverse to the phenomena of the overshoot.

Figure 8:
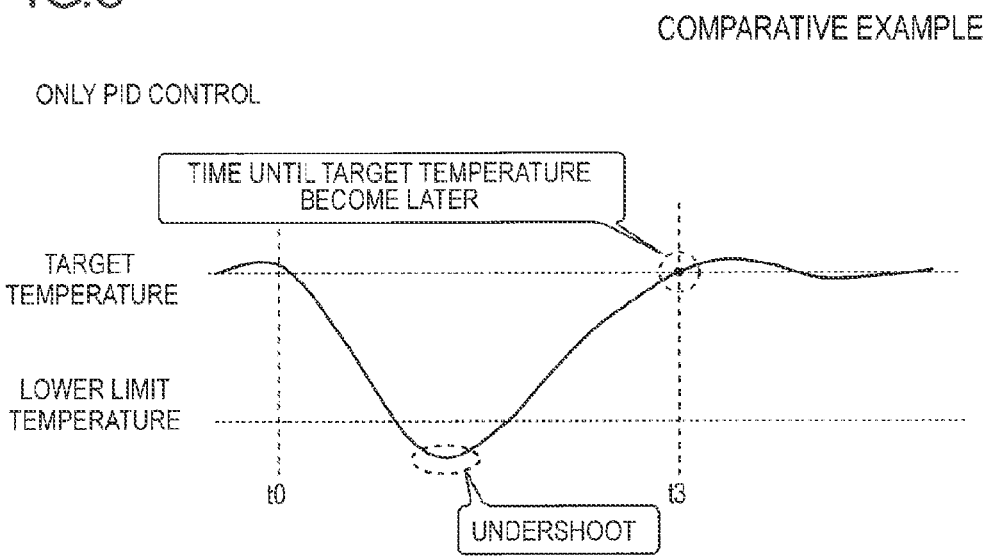
FIG. 8 is a diagram showing temperature transition in the case of using only a PID control as a fixing control of a comparative example.

FIG. 8 is a diagram showing temperature transition in the case of using only a PID control as the fixing control in a comparative example. In the PID control which uses a duty ratio set in accordance with a temperature difference between the target temperature and a detected temperature, immediately after the time to, since a small duty ratio (for example, 60 to 80%) as compared with the ON/OFF control is used, undershoot lower than the lower limit temperature occurs. Further, as compared with the ON/OFF control shown in FIG. 7, the time (the time t3) until the temperature which has fallen once reaches the target temperature again, becomes longer.

Figure 9:
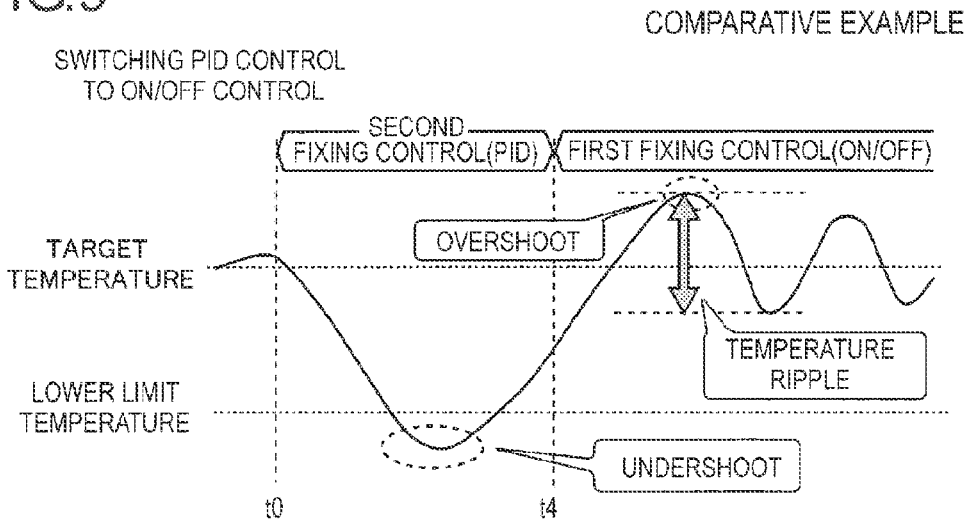
FIG. 9 is a diagram showing temperature transition in the case of using a fixing control which executes a PID control at an initial stage and thereafter switches to an ON/OFF control as a comparative example.

FIG. 9 is a diagram showing temperature transition in the case of using the fixing control as a comparative example in which a PID control is executed immediately after the time t0, and thereafter, at the time t4, the fixing control is switched to an ON/OFF control. In the example shown in FIG. 9, many problems, such as undershoot at an initial stage, overshoot after the temperature has reached the target temperature, and temperature ripples, have occurred.

Figure 10:
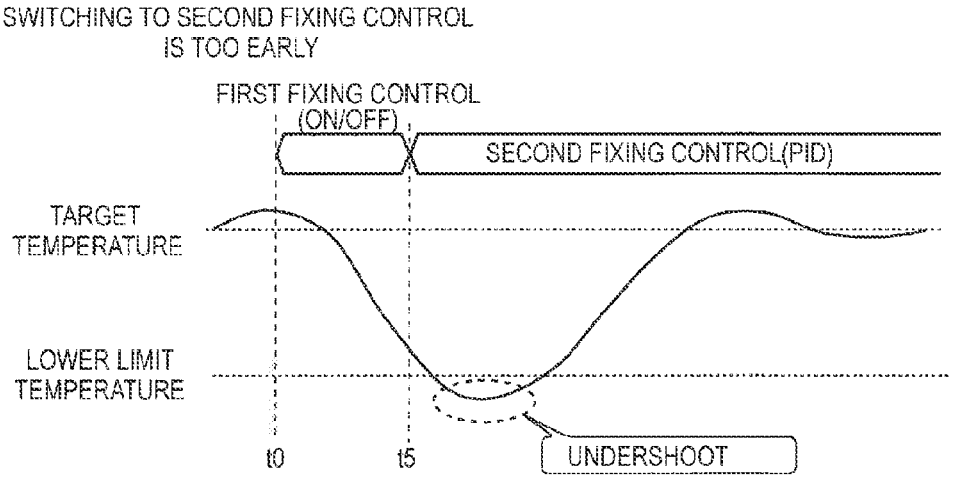
FIG. 10 is a diagram showing temperature transition in the case of executing a first fixing control (an ON/OFF control) at an initial stage, and thereafter, at an early timing, switching to a second fixing control (a PID control), as a comparative example.

FIG. 10 is a diagram showing temperature transition in the case of using the fixing control as a comparative example in which a first fixing control (an ON/OFF control) is executed immediately after the time to, and thereafter, at a predetermined timing (the time t5) earlier than the time when the temperature reaches a lower limit value, the fixing control is switched to a second fixing control (a PID control). In this case, since the switching to the second fixing control is too early, there are fears that undershoot lower than the lower limit temperature may occur.

Figure 11:
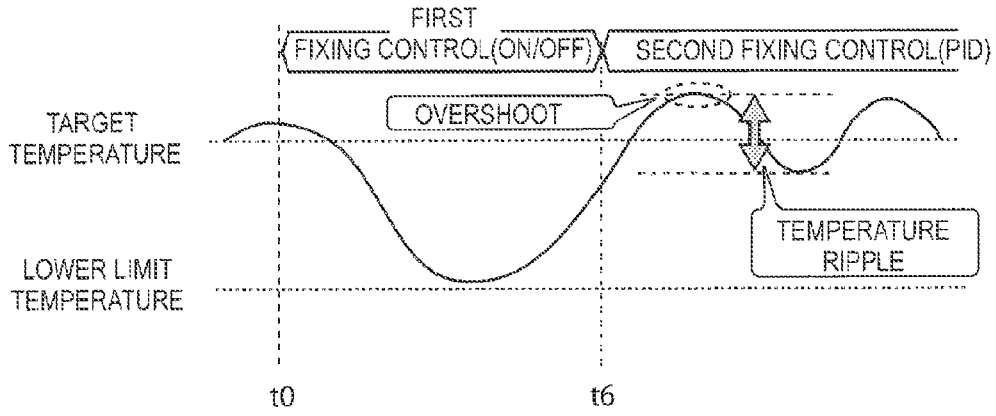
FIG. 11 is a diagram showing temperature transition in the case of executing a first fixing control (an ON/OFF control) at an initial stage, and thereafter, at a late timing, switching to a second fixing control (a PID control), as a comparative example.
Figure 12:
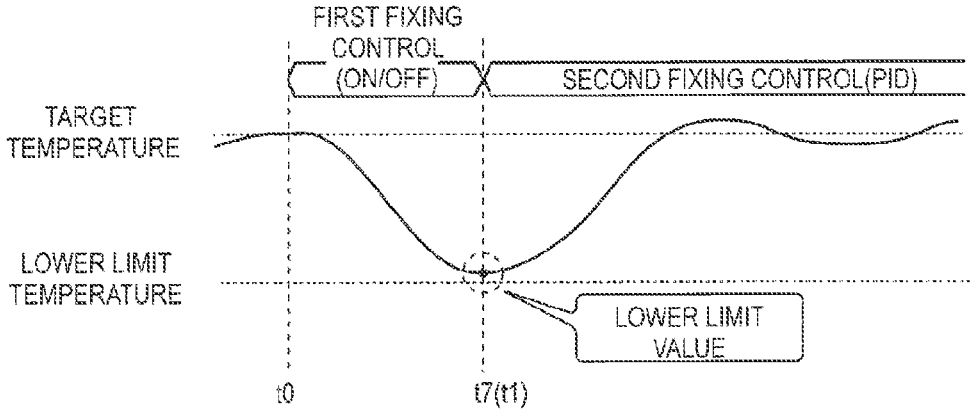
FIG. 12 is a diagram showing temperature transition in the case of using a fixing control according to the present embodiment.

FIG. 11 is a diagram showing temperature transition in the case of using the fixing control as a comparative example in which a first fixing control (an ON/OFF control) is executed immediately after the time t0, and thereafter, at a predetermined timing (the time t6) later than the time when the temperature reaches a lower limit value, the fixing control is switched to a second fixing control (a PID control). In this case, since the switching to the second fixing control is too late, there is fear that overshoot may occur after the temperature has reached the target temperature and temperature ripples may occur within a period until the overshoot converges.

FIG. 12 is a diagram showing temperature transition in the case of using the fixing control according to the present embodiment as an example. In the fixing control according to the present embodiment, a first fixing control (an ON/OFF control) is executed immediately after the time t0, and thereafter, at a time (the time t7 (corresponding to the time t1 in FIG. 6)) when the temperature has reached a lower limit value for the first time, the fixing control is switched to a second fixing control (a PID control). In the case of using such a fixing control, as compared with the comparative examples shown in FIG. 7 to FIG. 11, neither undershoot lower than the lower limit temperature nor excessive overshoot after the temperature has reached the target temperature, occurs. Further, the time until the temperature has reached the target temperature for the first time also can be made shorter than the comparative example shown in FIG. 8.

In this way, according to the present embodiment, when an image forming operation is started from a standby state, electric power is supplied to a heater by a first fixing control which turns on and off the heater to heat a fixing member with a fixed duty ratio based on the detected temperature of the fixing member. Thereafter, when having detected the state that the falling detected temperature has reached the lower limit value at which the detected temperature turns to rising, the fixing control is switched to a second fixing control which changes a duty ratio in accordance with a temperature difference between the detected temperature and a target control temperature, and electric power is supplied to the heater by the second fixing control. By controlling in such a way, when an image forming operation is started, the temperature of the fixing member is made to converge to a target control temperature at an early stage, and it becomes possible to minimize undershoot, overshoot, and temperature ripples.

(Fixing Temperature Control According to a Second Embodiment)

Figure 13:
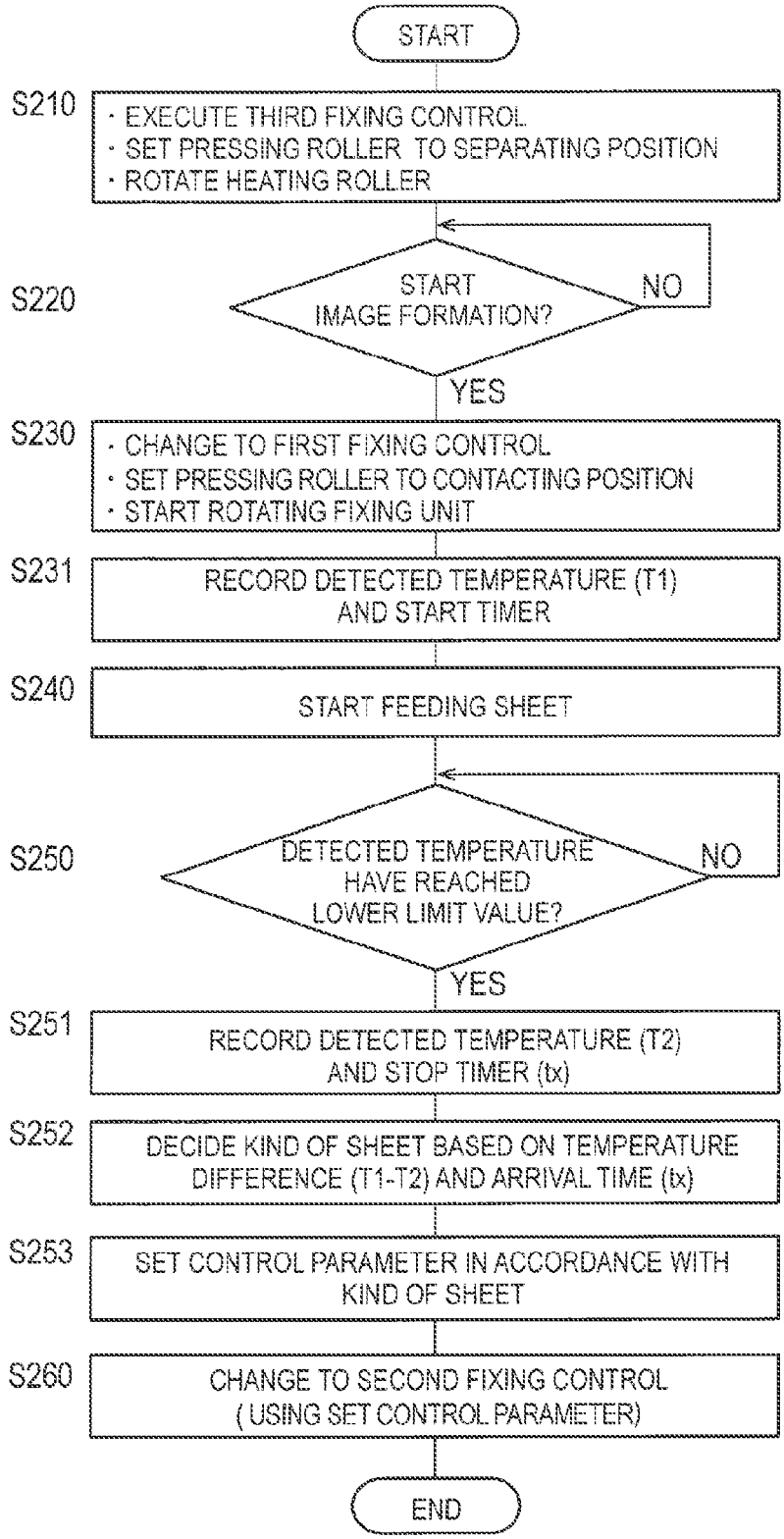
FIG. 13 is a flowchart showing a fixing temperature control according to the second embodiment.

With reference to FIG. 13 and FIG. 14, the fixing temperature control according to the second embodiment is described. FIG. 13 is a flowchart showing the fixing temperature control executed by the controller 110 according to the second embodiment. In the flowchart in FIG. 13, each of Steps S210, S220, S230, S240, and S250 corresponds to a corresponding one of Steps S110 to S150 in the flowchart in FIG. 5 as it is.

At Steps S210 to S230 in FIG. 13, the similar processing as that at Steps S110 to S130 in FIG. 5 is executed. At the subsequent Step S231, the detected temperature of the temperature sensor 131 at that time is recorded (the temperature T1, refer to FIG. 6). At the same time, the measurement of a timer is started. Thereafter, at Step S240, conveyance of a sheet S is started. The measurement of the timer may be started from a time point when the first sheet has reached the fixing nip portion.

Thereafter, at Step S250, with the similar processing as that at the above-mentioned Step S150, the detected temperature of the temperature sensor 131 is read in with a given cycle, and, based on the transition of the detected temperatures, it is decided whether the detected temperature has reached a lower limit value at which the detected temperature turns to rising.

In the case where it is decided that the detected temperature has reached the lower limit value (S250: YES), at the subsequent Step S251, the detected temperature at this time is recorded (the temperature T2, refer to FIG. 6), and the timer is made to stop (the time t1). At this time, the measurement value of the timer is defined as tx (hereafter, referred to as "arrival time tx").

At Step S252, the controller 110 which functions also as a sheet kind deciding section (refer to FIG. 3) decides the kind of a sheet based on a temperature difference (T1−T2) between the recorded detected temperatures and the arrival time tx. As the temperature difference is larger, or as the arrival time is longer, the sheet is decided as a thick sheet (a sheet with a large weight). For example, in the case where the temperature difference is lower than 5° C. and the arrival time is less than 3 seconds, the kind of a sheet is decided as a thin sheet (for example, with a basis weight of 50 g/m2). On the other hand, in the case where the temperature difference is equal to or higher than 10° C. and the arrival time is equal to or more than 5 seconds, the kind of a sheet is decided as a thick sheet (for example, with a basis weight of 128 g/m2).

At Step S253, a control parameter is set in accordance with the decided kind of a sheet. FIG. 14 shows an example of a table to determine a P constant (a proportional term) of a PID control as a control parameter in accordance with the kind of a sheet. In the table shown in FIG. 14, the value of the control parameter is set such that as a sheet is thicker, a duty ratio becomes higher. By using the table shown in FIG. 14, the control parameter is set in accordance with a combination of a temperature difference (T1−T2) and an arrival time (tx). For example, in the case where the temperature difference is 7° C. and the arrival time is 4 seconds, the P constant is set to 5. In the example in FIG. 14, only the P constant is exemplified. However, the similar table may be also provided for an I constant (an integral term) and a D constant (a derivative term).

At the subsequent Step S260, the fixing control is switched from the first fixing control to the second fixing control, and thereafter, the fixing temperature control is executed by the second fixing control. The control parameter used at this time is the control parameter set at Step S253. For example, if the P constant is 5, a duty ratio can be determined by multiplying this by a temperature difference between the detected temperature of the temperature sensor 131 at the time of control and the target control temperature.

In the second embodiment, the kind of a sheet is decided based on a temperature difference (T1−T2) and an arrival time (tx), and then a control parameter used in the second fixing control is set in accordance with the decided kind of the sheet, whereby a duty ratio calculated from the control parameter can be set to a suitable value. In the case where the control parameter is set to an excessively large value, a problem also arises in that excessive overshoot may be caused after the temperature has reached the target temperature. On the other hand, in the case where the control parameter is set to an excessively small value, another problem arises in that it takes time too much to reach the target temperature. According to the second embodiment, a suitable fixing temperature control can be performed stably without causing such problems.

Modified Embodiment

In the second embodiment shown in FIG. 13, the kind of a sheet is decided based on a temperature difference (T1−T2) and an arrival time (tx). However, the kind of a sheet may be decided by using only any one of them. It becomes difficult to decide sheet thicknesses (weights) classified finely into multi-stages. However, such decision has a merit in the point that control becomes easier.

The sheet kind information decided at Step S252 in FIG. 13 is correlated with the sheet feeding tray 181 (or 182) which feeds the sheets, and then, stored with the correlation in the storage unit 140. Thereafter, unless another kind of sheets are filled up in the sheet feeding tray 181, by using the stored sheet kind information, each processing with regard to the sheet kind decision in S231, S251, and S252 may be omitted. Further, the sheet kind decision itself may be omitted, and sheet kind information set by a user via the operation display unit 150 may be used. In this case, the operation display unit 150 and the controller 110 are made to cooperatively function as the sheet information acquiring section.

Other Modified Embodiments

FIG. 13 and FIG. 14 show an example which a P constant as a control parameter is set in accordance with the kind of a sheet (the thickness of a sheet). In the following modified embodiments, as other factors in place of the kind of a sheet, an in-machine temperature or a sheet conveying speed is used.

FIG. 15 shows a table used at the time of determining a P constant as a control parameter used in the second fixing control in accordance with the detected temperature of an in-machine temperature sensor 129 (refer to FIG. 1) which detects a temperature in the main body of the image forming apparatus 10. In this table, the value of a control parameter is set such that as the detected temperature of the in-machine temperature sensor 129 is lower, a duty ratio may become higher. This table is referred at each time when the fixing control is switched to the second fixing control at Step S160 in FIG. 5. Thereafter, the second fixing control is executed by using a value in the table.

FIG. 16 shows a table used at the time of determining a P constant as a control parameter used in the second fixing control in accordance with the sheet conveying speed in the sheet conveying unit 180 and the fixing unit 130. This sheet conveying speed is changed by the setting of gloss intensity with the designation of a user. In this table, the value of a control parameter is set such that as the sheet conveying speed is faster, a duty ratio becomes higher. This table is referred at each time when the fixing control is switched to the second fixing control at Step S160 in FIG. 5. Thereafter, the second fixing control is executed by using a value in the table.

As factors which influence the temperature transition of fixing, there are an in-machine temperature (i.e. a temperature in a machine) and a sheet conveying speed. Since an in-machine temperature is effective as an index to estimate a heat accumulation amount of the fixing unit 130 such as the pressing roller 136 at a time point of the time t0 (refer to FIG. 6), the detected value of the in-machine temperature sensor 129 is used. In the case where a heat accumulation amount is large, a quantity of heat which shifts from the heating roller 135 to the pressing roller 136 due to the rotation start of the fixing unit 130 after the time t0, becomes relatively small. Accordingly, even if an amount of power supplied to the heaters L31 and L32 at the initial stage (for example, within a period shown in FIG. 12) is small, the heating roller 135 can be heated sufficiently. Therefore, the in-machine temperature is one of the above factors. Since the sheet conveying speed influences an amount of sheets which pass through the fixing nip portion per a unit time, it also influences a quantity of heat taken (supplies) by sheets at the fixing nip portion per a unit time. Therefore, the sheet conveying speed is one of the above factors.

In the case where a control parameter is set to an excessively large value, a problem arises in that excessive overshoot may be caused after the temperature has reached the target temperature. On the other hand, in the case where the control parameter is set to an excessively small value, another problem arises in that it takes time too much to reach the target temperature. By setting the control parameter used in the second fixing control to a suitable value in accordance with an in-machine temperature or a sheet conveying speed, a suitable fixing temperature control can be performed stably without causing such problems.

In the examples in FIG. 14 to FIG. 16, a control parameter of a calculation formula to determine a duty ratio used in the second fixing control in accordance with a temperature difference between a detected temperature and a target temperature is set in accordance with respective factors of the kind of a sheet (a temperature difference and an arrival time), an in-machine temperature, and a sheet conveying speed. In place of above setting manner, the setting may be performed by using a control table which describes a relationship (corresponding to a P control) between a temperature difference between a detected temperature and a target control temperature and a duty ratio. Further, a plurality of such control tables are prepared in accordance with respective factors of the kind of a sheet (a temperature difference and an arrival time), an in-machine temperature, and a sheet conveying speed, and stored in the storage unit 140. Then, a control table to be referred may be selected from the plurality of control tables in accordance with a corresponding one of the factors.

In addition, the present invention is prescribed by the contents described in the claims, and various modified embodiments may be possible to be made.

What is claimed is:

1. An image forming apparatus, comprising:

a sheet feeding tray which stores sheets;

a sheet conveying unit which conveys a sheet stored in the sheet feeding tray;

an image forming unit which forms a toner image on the sheet conveyed by the sheet conveying unit;

a fixing member which heats and fixes the toner image formed by the image forming unit onto the sheet;

a temperature sensor which detects the temperature of the fixing member;

a heater which heats the fixing member;

an electric power supplying unit which switches ON and OFF of the heater in accordance with a duty ratio which represents a ratio of an ON period to supply electric power to the heater within a predetermined cycle; and a controller which determines the duty ratio based on the detected temperature of the temperature sensor and controls the electric power supplying unit based on the determined duty ratio so as to supply electric power to the heater;

wherein the controller can control the electric power supplying unit by a first fixing control which turns on the heater with a fixed duty ratio when the detected temperature is equal to or lower than a target control temperature and turns off the heater when the detected temperature is higher than the target control temperature and by a second fixing control which changes the duty ratio in accordance with a temperature difference between the detected temperature and the target control temperature, and wherein when an image forming operation is started from a standby state in which the fixing member is subjected to temperature control such that the detected temperature becomes a predetermined control temperature, the controller supplies electric power to the heater by the first fixing control, thereafter, when detecting a state that the falling detected temperature reaches a lower limit value at which the detected temperature turns to rising, the controller switches to the second fixing control and supplies electric power to the heater by the second fixing control.

2. The image forming apparatus described in claim 1, wherein the fixing member includes a heating roller heated by the heater and a pressing roller which is movable selectively to a contacting position at which the pressing roller comes in contact with the heating roller so as to form a fixing nip portion therebetween and to a separating position at which the pressing roller comes in non-contact with the heating roller, wherein in the standby state, the controller makes the pressing roller stand still at the separating position, makes the heating roller rotate, and controls such that the detected temperature of the heating roller becomes the predetermined control temperature, and wherein with an instruction to start an image forming operation, the controller moves the pressing roller to the contacting position and starts driving the heating roller and the pressing roller.

3. The image forming apparatus described in claim 1, further comprising a sheet information acquiring section to acquire the kind of a sheet stored in the sheet feeding tray, wherein the controller includes a plurality of control tables to determine the duty ratio in accordance with a temperature difference in the second fixing control or a plurality of control parameters of a calculation formula to determine the duty ratio in accordance with a temperature difference, and the controller changes the control table or the control parameter in accordance with the kind of a sheet acquired from the sheet information acquiring section.

4. The image forming apparatus described in claim 3, wherein the sheet information acquiring section includes a deciding section to decide the kind of a sheet based on at least one of an elapsed time from a time when staring the first fixing control or a time when staring a heating treatment for the first sheet to a time when detecting a state that the temperature reaches the lower limit value and a temperature difference between the detected temperature at the time of staring the first fixing control and the lower limit value.

5. The image forming apparatus described in claim 3, wherein the control table or the control parameter is set such that as a sheet is thicker, the duty ratio becomes higher.

6. The image forming apparatus described in claim 1, further comprising an in-machine temperature sensor to detect a temperature in a main body, wherein the controller includes a plurality of control tables to determine the duty ratio in accordance with a temperature difference in the second fixing control or a plurality of control parameters of a calculation formula to determine the duty ratio in accordance with a temperature difference, and the controller changes the control table or the control parameter in accordance with the detected temperature of the in-machine temperature sensor.

7. The image forming apparatus described in claim 6, wherein the control table or the control parameter is set such that as the detected temperature of the in-machine temperature sensor is lower, the duty ratio becomes higher.

8. The image forming apparatus described in claim 1, wherein the sheet conveying unit can change a conveying speed to convey a sheet to the fixing member in multi-stages, and the controller includes a plurality of control tables to determine the duty ratio in accordance with a temperature difference in the second fixing control or a plurality of control parameters of a calculation formula to determine the duty ratio in accordance with a temperature difference, and the controller changes the control table or the control parameter in accordance with the conveying speed.

9. The image forming apparatus described in claim 8, wherein the control table or the control parameter is set such that as the conveying speed is faster, the duty ratio becomes higher.

* * * * *